United States Patent [19]

Roces

[11] 3,938,332

[45] Feb. 17, 1976

[54] HYDRAULIC COUPLING MECHANISM

[76] Inventor: Rafael Tuti Roces, 1846-C F. Agoncillo St., Ermita, Manila, Philippines

[22] Filed: Apr. 29, 1974

[21] Appl. No.: 465,098

[30] Foreign Application Priority Data

Dec. 27, 1973 Philippines ..... 15360

[52] U.S. Cl. ..... 60/536; 60/581

[51] Int. Cl.[2] ..... F15B 7/02

[58] Field of Search ..... 60/581, 536, 571; 188/345

[56] References Cited

UNITED STATES PATENTS

| | | | |
|---|---|---|---|
| 386,116 | 7/1888 | DuBois | 60/536 |
| 2,584,659 | 2/1952 | Audemar et al. | 60/536 |
| 2,597,050 | 5/1952 | Audemar | 60/536 |
| 2,924,944 | 2/1960 | Matlachowsky | 60/581 |
| 3,548,594 | 12/1970 | Ceppi | 60/581 |
| 3,645,126 | 2/1972 | Karlowetz et al. | 60/581 |

*Primary Examiner*—Martin P. Schwadron
*Assistant Examiner*—H. Burks, Sr.

[57] ABSTRACT

This hydraulic coupling mechanism consists of at least a pair of pressure transmitting cylinders which are operated in a predetermined sequence, at least a pair of pressure receiving cylinders synchronously operated by the pressure transmitting cylinders through corresponding closed liquid lines, each of which is provided with a corresponding pressure adjustable cylinder.

1 Claim, 8 Drawing Figures

18
18a
19
19a
20
20a
21
21a
22
22a
23
23a
24
24a
25
25a
26
27
28
29
30
31
32
33
34
35
37
39
40
41
42
43
A
B
E
F

HYDRAULIC COUPLING MECHANISM

DESCRIPTION OF THE INVENTION

This invention relates particularly to a hydraulic coupling mechanism for transmitting rotary motion.

Rotary motion is transmitted usually a means of belts, chains and gears or combinations thereof. These means for transmitting rotary motion have, however, high transmission losses and are suitable only to certain arrangements of the power transmitting shaft with the power receiving shaft.

The object, therefore, of this invention is to provide a mechanism for transmitting rotary motion which has a very low transmission loss and at the same time suitable for any arrangement of the power transmitting source with the power receiver.

Another object is to provide a mechanism for transmitting rotary motion which is very simple and requires minimum maintenance.

Other objects, features and advantages of the present invention will become apparent after a study of the following detailed description of the accompanying drawings, forming part of this specification, wherein:

FIG. 7 is also a fragmentary cross-sectional view taken generally along line 7—7 of FIG. 4.

FIG. 8 is another fragmentary cross-sectional view taken generally along line 8—8 of FIG. 4.

Figures 1, 2, 3:
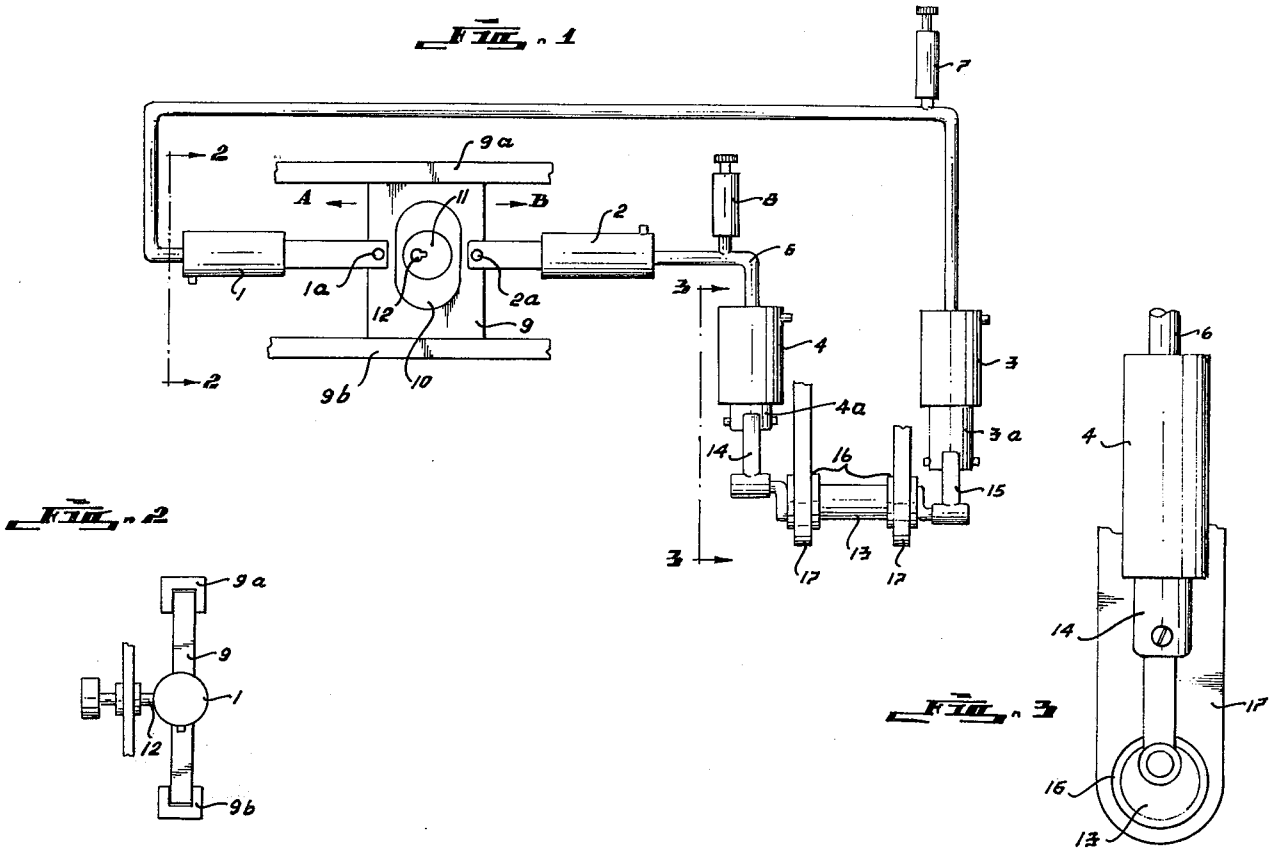
FIG. 1 is an schematic representation of one embodiment of the hydraulic coupling mechanism in its basic form, using a pair of transmitting hydraulic cylinders and a pair of receiving hydraulic cylinders.
FIG. 2 is a fragmentary cross-sectional view taken generally along line 2—2 of FIG. 1.
FIG. 3 is another fragmentary view taken generally along line 3—3 of FIG. 1.

The hydraulic coupling mechanism as shown in FIGS. 1–3, includes a pair of transmitting hydraulic cylinders 1 and 2 which are connected to a pair of receiving hydraulic cylinders 3 and 4, by closed liquid pipe lines 5 and 6, respectively. Connected to each of the liquid pipelines lines 5 and 6 are the regulating hydraulic cylinders 7 and 8, respectively, used for equalizing the liquid pressures in said lines and which also serve as shock absorbers, thereby assuring smooth operation of the mechanism.

Within the transmitting hydraulic cylinders are disposed the respective pistons (not shown), the ends 1*a* and 2*a* of which are pivotally connected opposite each other to one pair of opposed sides of a reciprocating rectangular member 9, the other pair of opposed sides of which are slidably disposed along the opposed channel members 9*a* and 9*b*, as shown in FIG. 2.

As shown in FIG. 1, the rectangular member 9 has an opening 10 having a generally elliptical shape within which the cam 11 is rotatively disposed. The cam 11 is eccentrically disposed on the shaft 12 such that upon rotation of said shaft, the cam imparts reciprocating movement to the pistons 1*a* and 2*a* as indicated by the arrows A and B. This reciprocating movement of the pistons causes synchronous flow of the liquid in the pipe lines 5 and 6 into the receiving cylinders 3 and 4. Since the pistons 3*a* and 4*a* of the hydraulic cylinders 3 and 4, respectively, have a phase difference of 180°, said pistons impart a rotary motion to the crankshaft 13. The crankshaft 13, as shown in FIG. 1, is rotatively mounted on bushings or bearings 18 journaled on conventional support 17.

The embodiment shown in FIG. 1 is designed for bicycles, so that the crankshaft 13 of the mechanism serves also as the shaft of the rear wheel of the bicycle. The shaft 12 which constitutes the driving shaft may be actuated by means of conventional foot pedals or the same may be rotated by a conventional gasoline engine or an electric motor run by a suitable battery.

Figure 4:
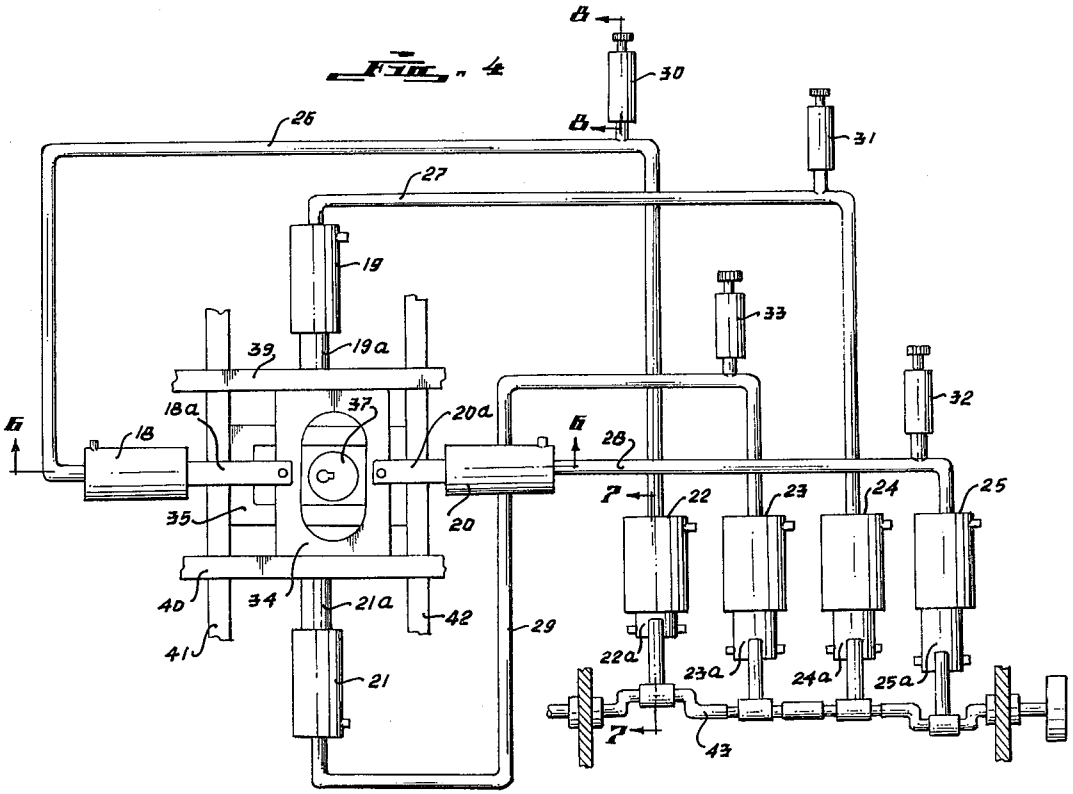
FIG. 4 is an schematic view of another embodiment of the hydraulic coupling mechanism, using four transmitting and four receiving hydraulic cylinders.

The embodiment shown in FIG. 4 of the hydraulic coupling mechanism has substantially the same parts, except that it has several transmitting cylinders and receiving cylinders to achieve smoother operation. This embodiment of the hydraulic coupling mechanism includes four hydraulic transmitting cylinders 18, 19 20 and 21 which are connected to the four hydraulic receiving cylinders 22, 23, 24 and 25 by the fluid pipe lines 26, 27, 28 and 29, respectively. Connected to each of the fluid pipe lines 26, 27, 28 and 29 are the regulating hydraulic cylinders 30, 31, 32 and 33, the functions of which are to equalize the pressures in the different fluid lines and at the same time serve as shock absorbers.

Figures 2, 3, 5, 6:
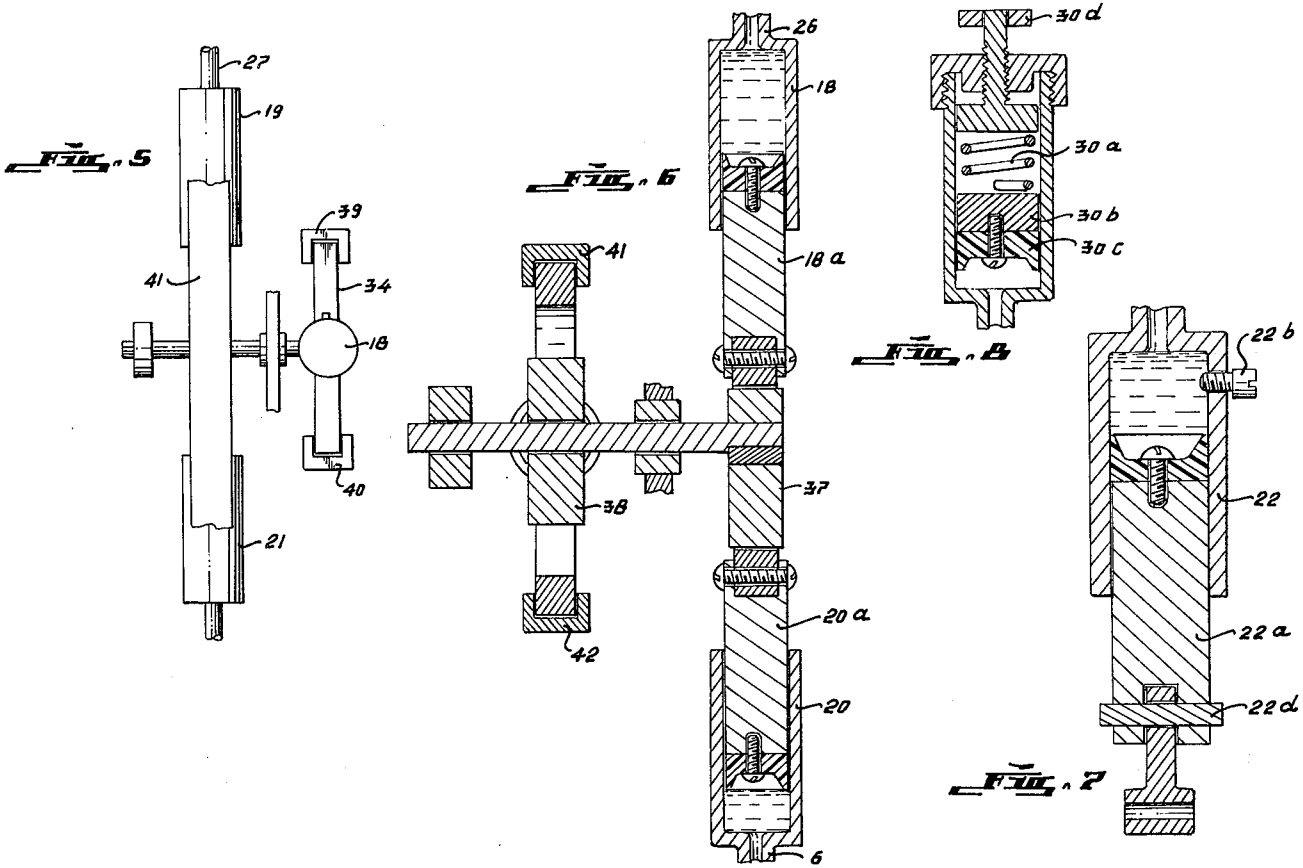
FIG. 5 is a fragmentary cross-sectional view taken generally along line 5—5 of FIG. 4.
FIG. 6 is a fragmentary cross-sectional view taken generally along line 6—6 of FIG. 4.

Referring now to FIGS. 4, 5 and 6, this embodiment of the hydraulic coupling mechanism has a pair of reciprocating rectangular members 34 and 35, each of which has a generally elliptical opening similar to that described in the first embodiment. Each of said generally elliptical openings is adapted to accommodate each of the cams 37 and 38 which are eccentrically disposed on a common shaft. As shown in FIG. 4, a pair of opposed sides of the reciprocating rectangular member is slidably disposed in the channels of the upper and lower bars 39 and 40, while the other pair of opposed sides of said reciprocating rectangular member are pivotally attached to the ends of the pistons 18*a* and 20*a* of the cylinders 18 and 20. Reciprocating rectangular member 35 has a pair of opposed sides which are slidably mounted in the channels of another set of bars 41 and 42, and said reciprocating rectangular member move perpendicularly relative to the movement of the other reciprocating member 34.

Relative movement of the reciprocating rectangular members 34 and 35 causes sequential operation of the transmitting pistons 18*a*, 19*a*, 20*a* and 21*a*, of the transmitting hydraulic cylinders which in turn cause corresponding sequential operations of the receiving pistons 22*a*, 23*a*, 24*a* and 25 of the receiving hydraulic cylinders.

Since this mechanism has four transmitting hydraulic cylinders, the two cams 37 and 38 thereof are so arranged to cause compression movement of one pistons every 90° of shaft rotation, thus one piston of the receiving hydraulic cylinders is correspondingly actuated at every 90° of rotation resulting in a continuous smooth rotation of the crankshaft 43.

The regulating hydraulic cylinders in both embodiments of the hydraulic coupling mechanism are identical. As shown in FIG. 8, each of said regulating hydraulic cylinders includes a coil spring 30*a* which biases the piston 30*b*, the leading side of which is provided with a rubber seal 30*c*. At the upper end of the coil spring 30*a* is a pusher plate 30*d* which is provided with an adjustable handle 30*d* screwably disposed through the threaded hole of the cylinder cover 30*f*.

Details of the identical receiving hydraulic cylinders are shown in FIG. 7. Each of said receiving hydraulic cylinders has a bleeder plug 22*b*, a rubber seal 22*c* at trailing or inner end of the piston 22*a*. The outer or leading side of the piston 22*a* is connected pivotally to the piston rod by a pin 22*d*.

While it is apparent that the preferred embodiments of the invention disclosed above are designed to fulfill the objects mentioned, it is understood that this invention is susceptible to modification, variation and change without departing from the essence of the invention as defined in the appended claims.

I claim:

1. A hydraulic coupling mechanism for bicycles comprising:

at least a pair of opposed spaced apart channel members;

a rectangular member having a pair of opposed sides which are disposed slidably along said opposed channel members and a pair of opposed free sides, said rectangular member having a generally elliptical opening at the middle thereof;

a drive shaft disposed normally through said elliptical opening in said rectangular member;

means for rotating said drive shaft;

a cam disposed eccentrically on said drive shaft and within said elliptical opening to reciprocate said rectangular member upon rotation of said shaft;

a pair of transmitting hydraulic cylinders disposed in close proximity to the opposed free sides of said rectangular member, each of siad transmitting hydraulic cylinders having a corresponding piston rod the outer end of which is connected to the adjacent free opposed side of said rectangular member;

a pair of hydraulic receiving cylinders operably and synchronously connected to said transmitting hydraulic cylinders each of said hydraulic receiving cylinders having a corresponding piston rod; and a crankshaft operably connected to said piston rods of said hydraulic receiving cylinders, said crankshaft serving as the shaft of the rear wheel of said bicycle.

* * * * *